US010945584B2

(12) United States Patent
Thiyagarajan et al.

(10) Patent No.: US 10,945,584 B2
(45) Date of Patent: Mar. 16, 2021

(54) DRYING ASSEMBLY FOR A WASHING APPLIANCE

(71) Applicant: Haier US Appliance Solutions, Inc., Wilmington, DE (US)

(72) Inventors: Ramasamy Thiyagarajan, Louisville, KY (US); Adam Christopher Hofmann, Louisville, KY (US); Abhisek Agrawal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 155 days.

(21) Appl. No.: 16/048,550

(22) Filed: Jul. 30, 2018

(65) Prior Publication Data

US 2020/0029784 A1 Jan. 30, 2020

(51) Int. Cl.
*A47L 15/48* (2006.01)

(52) U.S. Cl.
CPC ..... *A47L 15/483* (2013.01); *A47L 15/488* (2013.01)

(58) Field of Classification Search
CPC .. A47L 15/488; A47L 15/483; A47L 15/4285; A47L 15/4234; A47L 15/486; A47L 15/4291
See application file for complete search history.

(56) References Cited

U.S. PATENT DOCUMENTS

| | | | | |
|---|---|---|---|---|
| 8,603,260 | B2 | 12/2013 | Classen et al. | |
| 2006/0254623 | A1* | 11/2006 | Classen | A47L 15/483 134/56 D |
| 2013/0333238 | A1* | 12/2013 | Thiyagarajan | F28D 15/0275 34/476 |
| 2016/0022116 | A1* | 1/2016 | Delellis | A47L 15/486 34/218 |
| 2018/0030644 | A1* | 2/2018 | Hong | D06F 58/206 |
| 2019/0046004 | A1* | 2/2019 | Thiyagarajan | A47L 15/46 |
| 2019/0133412 | A1* | 5/2019 | Hofmann | A47L 15/507 |

FOREIGN PATENT DOCUMENTS

| | | | | |
|---|---|---|---|---|
| CN | 203506662 U | 4/2014 | | |
| DE | 102016201688 A1 * | 8/2017 | | A47L 15/483 |
| EP | 3257425 A1 | 12/2017 | | |

* cited by examiner

*Primary Examiner* — Michael E Barr
*Assistant Examiner* — Omar Chaudhri
(74) *Attorney, Agent, or Firm* — Dority & Manning, P.A.

(57) ABSTRACT

A drying system includes a tub defining a wet chamber with an outlet defined in the tub. The drying system also includes a heat exchanger comprising a plurality of heat pipes. Each heat pipe of the plurality of heat pipes has an evaporator section and a condenser section. The evaporator sections of the plurality of heat pipes define an evaporator section of the heat exchanger. The condenser sections of the plurality of heat pipes of the heat exchanger define a condenser section of the heat exchanger. The evaporator section of the heat exchanger is in fluid communication with the outlet to receive a flow of humid air from the outlet. The dishwashing appliance also includes an inlet defined in the tub. The inlet is configured to receive a flow of dry air from the condenser section of the heat exchanger.

14 Claims, 7 Drawing Sheets

DRYING ASSEMBLY FOR A WASHING APPLIANCE

FIELD OF THE INVENTION

The present subject matter relates generally to washing appliances, such as dishwashing appliances and, more particularly, to a drying assembly for reducing humidity within a washing appliance.

BACKGROUND OF THE INVENTION

Dishwashing appliances generally include a tub that defines a wash chamber. Rack assemblies can be mounted within the wash chamber for receipt of articles for washing where, e.g., detergent, water, and heat, can be applied to remove food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles.

Fluids used in the cleaning process may be heated. For example, hot water may be supplied to the dishwasher and/or the dishwasher may include one or more heat sources for heating fluids used in wash or rinse cycle and for providing heat during a drying cycle. It is common to provide dishwashers with rod-type, resistive heating elements in order to supply heat within the wash chamber during one or more of the dishwasher cycles (e.g. during the drying cycle). Generally, these heating elements include an electric resistance-type wire that is encased in a ceramic-filled, metallic sheath. The usage of such electric heaters typically leads to increased energy consumption. Moreover, a significant portion of the energy used to heat the fluids, e.g., for the wash cycle, may be wasted when hot, humid air is discharged from the dishwasher, e.g., during the dry cycle.

Accordingly, an improved heating device for a dishwashing appliance that provides for improved energy usage would be welcomed in the technology.

BRIEF DESCRIPTION OF THE INVENTION

Aspects and advantages of the technology will be set forth in part in the following description, or may be obvious from the description, or may be learned through practice of the technology.

In one embodiment a dishwashing appliance is provided. The dishwashing appliance includes a tub defining a wash chamber with an outlet defined in the tub. The dishwashing appliance also includes a heat exchanger comprising a plurality of heat pipes. Each heat pipe of the plurality of heat pipes has an evaporator section and a condenser section. The evaporator sections of the plurality of heat pipes define an evaporator section of the heat exchanger. The condenser sections of the plurality of heat pipes of the heat exchanger define a condenser section of the heat exchanger. The evaporator section of the heat exchanger is in fluid communication with the outlet to receive a flow of humid air from the outlet. The dishwashing appliance also includes an inlet defined in the tub. The inlet is configured to receive a flow of dry air from the condenser section of the heat exchanger.

In another embodiment, a drying system is provided. The drying system includes a tub defining a wet chamber with an outlet defined in the tub. The drying system also includes a heat exchanger comprising a plurality of heat pipes. Each heat pipe of the plurality of heat pipes has an evaporator section and a condenser section. The evaporator sections of the plurality of heat pipes define an evaporator section of the heat exchanger. The condenser sections of the plurality of heat pipes of the heat exchanger define a condenser section of the heat exchanger. The evaporator section of the heat exchanger is in fluid communication with the outlet to receive a flow of humid air from the outlet. The dishwashing appliance also includes an inlet defined in the tub. The inlet is configured to receive a flow of dry air from the condenser section of the heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
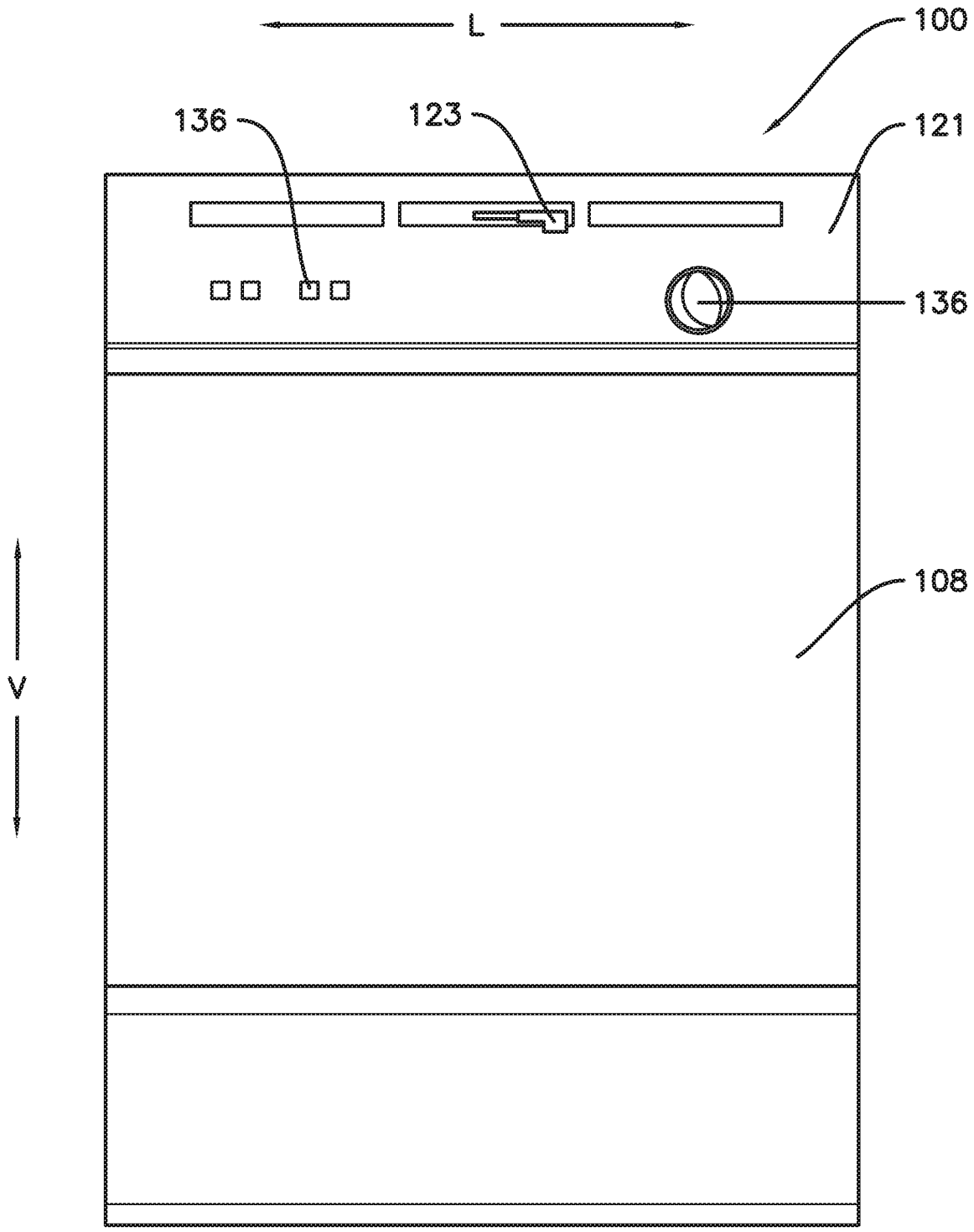
FIG. 1 illustrates a front view of an example dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
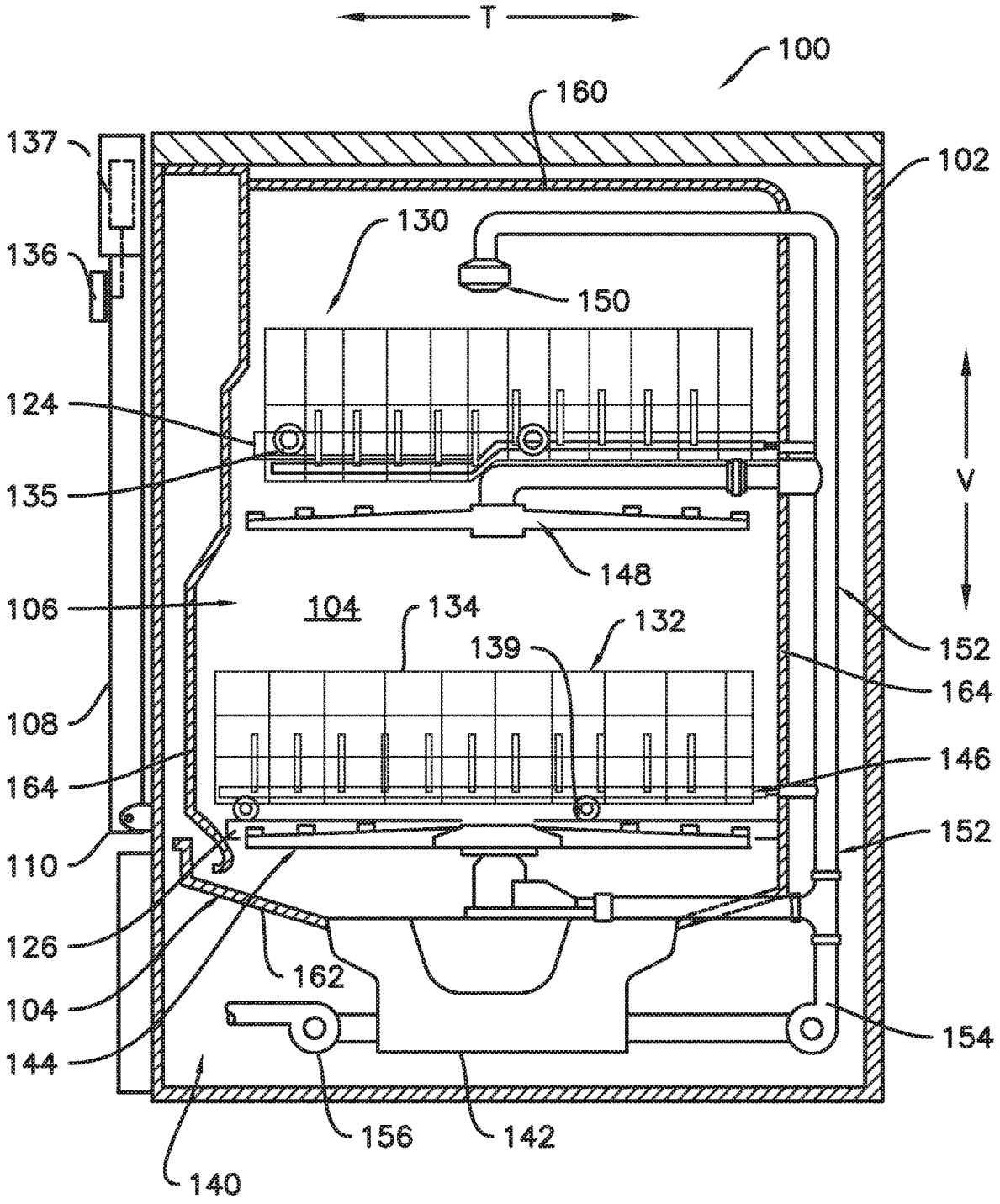
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
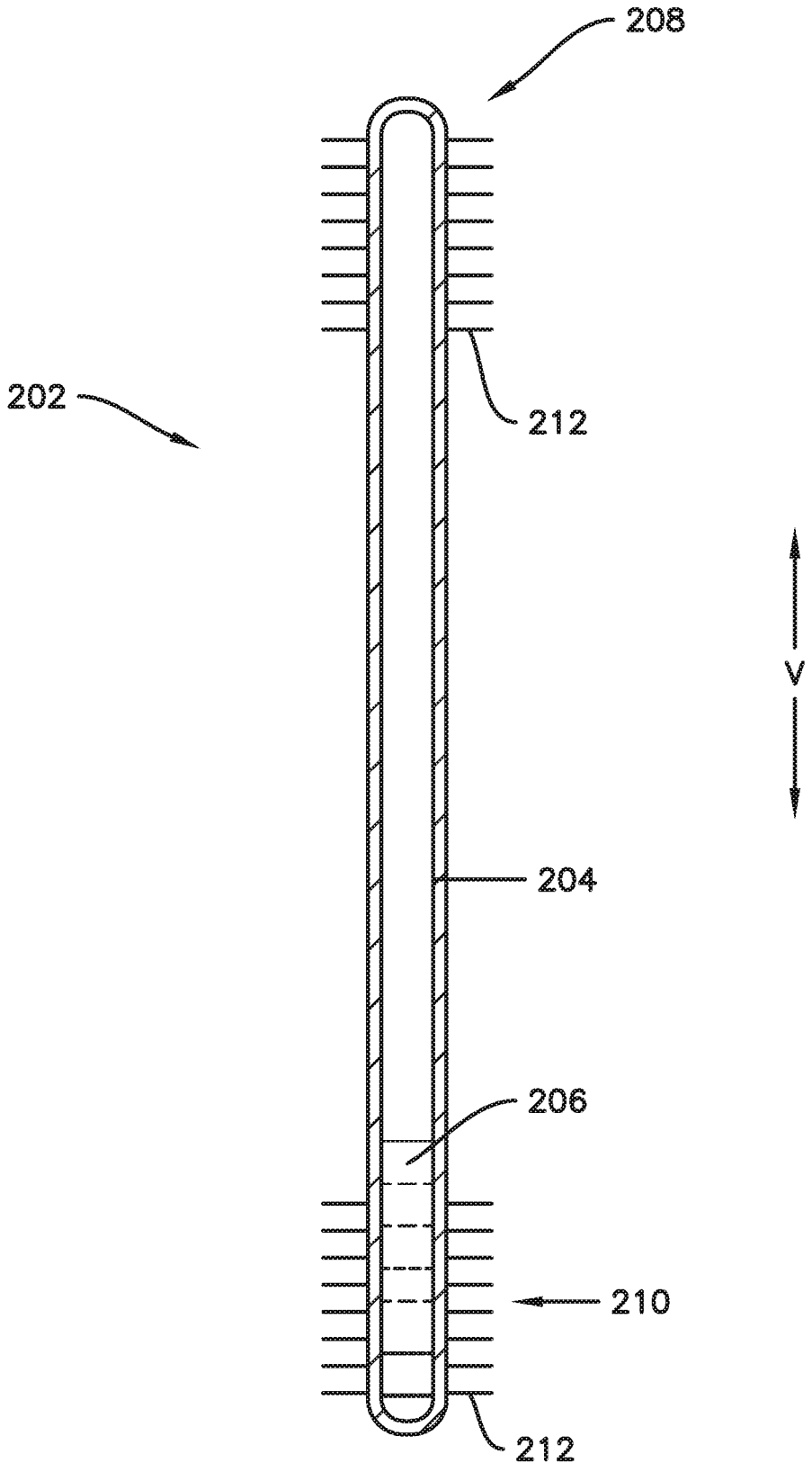
FIG. 3 provides a sectional view of an example heat pipe heat exchanger as may be incorporated in one or more embodiments of the present subject matter.

FIG. 3 illustrates an example heat pipe heat exchanger 202 which may be used as part of a heat exchanger 302 (FIGS. 4-7) of a drying system 300 (FIGS. 4-7) configured to promote drying of a wet chamber and/or of wet articles therein. A heat pipe heat exchanger, hereinafter referred to as a "heat pipe," is an efficient means of transferring thermal energy, e.g., heat, from one location to another. For example, in some embodiments, the heat pipe 202, as described in more detail hereinbelow, may be used to capture heat from a flow of hot, humid air at one end and the captured heat may be used to provide a flow of hot, dry air at the other end. For example, in some embodiments, the flow of hot, humid air may emanate from a wet chamber, e.g., the wet chamber may be the wash chamber 106 of dishwashing appliance 100 and wet articles, e.g., dishes, may be located therein.

As shown in FIG. 3, the heat pipe 202 includes a sealed casing 204 containing a working fluid 206 in the casing 204. In some embodiments, the working fluid 206 may be water. In other embodiments, suitable working fluids for the heat pipe 202 include acetone, glycol, methanol, ethanol, or toluene. In other embodiments, any suitable fluid may be used for working fluid 206, e.g., that is compatible with the material of the casing 204 and is suitable for the desired operating temperature range. The heat pipe 202 extends between a condenser section 208 and an evaporator section 210. The working fluid 206 contained within the casing 204 of the heat pipe 202 absorbs thermal energy at the evaporator section 210, whereupon the working fluid 206 travels in a gaseous state from the evaporator section 210 to the condenser section 208. The gaseous working fluid 206 condenses to a liquid state and thereby releases thermal energy at the condenser section 208. A plurality of fins 212 may be provided on an exterior surface of the casing 204 at one or both of the condenser section 208 and the evaporator section 210. The fins 212 may provide an increased contact area between the heat pipe 202 and air flowing around the heat pipe 202 for improved transfer of thermal energy.

The heat pipe 202 may include an internal wick structure (not shown) to transport liquid working fluid 206 from the condenser section 208 to the evaporator section 210 by capillary flow. In some embodiments, the heat pipe 202 may be constructed and arranged such that the liquid working fluid 206 returns to the evaporator section 210 solely by gravity flow. For example, as illustrated in FIG. 3, the heat pipe 202 may be arranged such that the condenser section 208 is positioned above the evaporator section 210 along the vertical direction V whereby condensed working fluid 206 in a liquid state may flow from the condenser section 208 to the evaporator section 210 by gravity. In such embodiments, where the liquid working fluid 206 may return to the evaporator section 210 by gravity, the wick structure may be omitted. Thus, the embodiment of FIG. 3 may advantageously provide a reduced cost and simpler heat pipe 202 by omitting the wick structure.

FIGS. 4 through 7 and the associated description hereinbelow will provide examples of various embodiments of the drying system 300 implemented in a dishwashing appliance 100. It should be appreciated, however, that the exemplary drying system 300 is not necessarily limited to use in a dishwashing appliance 100. In additional embodiments, the drying system 300 may be provided in other appliances or devices, such as a clothes dryer appliance, desiccator, or any other appliance or device wherein drying is desired.

Figure 4:
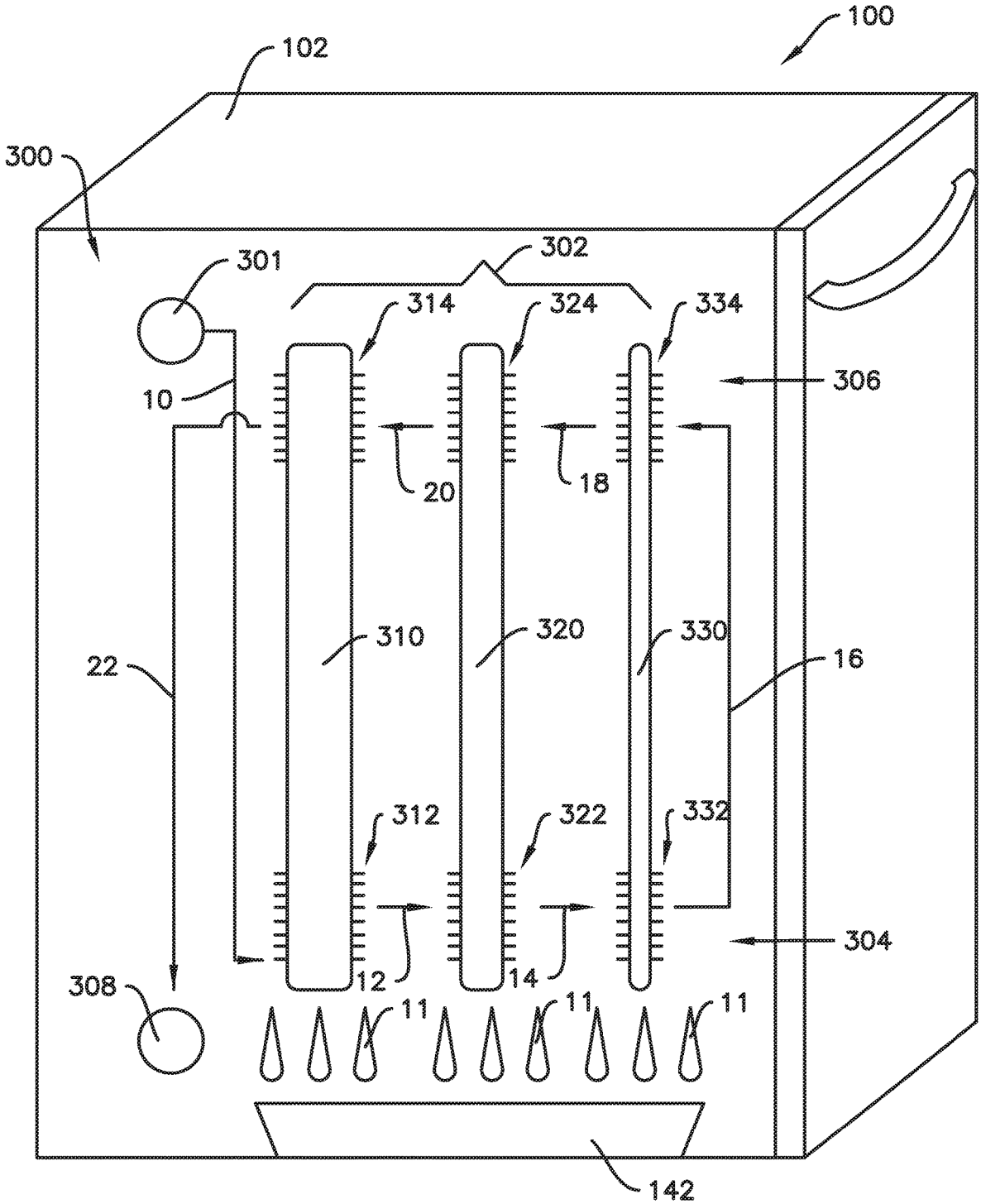
FIG. 4 provides a schematic view of a dishwashing appliance including a drying system according to one or more embodiments of the present subject matter.

As illustrated in FIG. 4, the drying system 300 may include an outlet 301 defined in the tub 104. The outlet 301 may provide fluid communication between the wet chamber, e.g., the wash chamber 106 in embodiments where the drying system 200 is provided in a dishwashing appliance 100, and the heat exchanger 302. The heat exchanger 302 may include a plurality of heat pipes, each of which is generally similar to the exemplary heat pipe 202 illustrated in FIG. 3 and described above. For example, as shown in FIG. 4, the heat exchanger 302 includes a first heat pipe 310, a second heat pipe 320, and a third heat pipe 330. In some embodiments, the heat pipes may be separate and distinct elements, e.g., the heat exchanger 302 may include a plurality of discrete heat pipes, and the heat pipes may be spaced apart from one another. The heat pipes 310, 320, and 330 may each have distinct operating temperatures and/or heating capacities. In the illustrated example of FIG. 4, the heat pipes 310, 320 and 330 are shown as having different sizes, e.g., diameters, which is one example way to vary the operating temperature and/or capacity of the heat pipes. In other examples, the heat pipes 310, 320, and 330 may also include different working fluids, different casing materials, and other variations, as well as or instead of different sizes to provide the distinct operating temperatures.

The use of multiple heat pipes with distinct operating temperatures in the heat exchanger 302 allows more efficient heat capture from the hot, humid air emanating from the outlet 301. For example, a greater portion of the heat from the hot exhaust can be captured with multiple heat pipes having distinct operating temperatures. The use of multiple heat pipes with distinct operating temperatures in the heat exchanger 302 also allows a wider range of temperatures, e.g., the air downstream of the heat exchanger 302 may be at a much lower temperature relative to the temperature of the exhaust air from the outlet 301, as compared to a drying system with a single heat pipe.

Each of the heat pipes 310, 320, and 330 includes an evaporator section and a condenser section, similar to the evaporator section 210 and the condenser section 208 of the exemplary heat pipe 202 shown in FIG. 3 and described above. As shown in FIG. 4, the evaporator sections 312, 322, and 332 of the respective heat pipes 310, 320, and 330, collectively define an evaporator section 304 of the heat exchanger 302. Similarly, the condenser sections 314, 324, and 334 of the respective heat pipes 310, 320, and 330, collectively define a condenser section 306 of the heat exchanger 302. The evaporator section 312 of the first heat pipe 310 may be immediately downstream of the outlet 301 and the condenser section 314 of the first heat pipe 310 may be downstream of the condenser section 324 of the second heat pipe 320 and immediately upstream of the inlet 308. As described below, the heat pipes 310, 320, and 330 may be arranged in serial flow order, such that air flows from the evaporator section 312 of the first heat pipe 310 to the evaporator section 322 of the second heat pipe 320, etc., and air flows from the condenser section 334 of the third heat pipe 330 to the condenser section 324 of the second heat pipe 320, etc.

In operation, a flow of hot humid air 10 may be drawn from the wet chamber, e.g., wash chamber 106, into the drying system 300 via the outlet 301. For example, when the drying system 300 is implemented in dishwashing appliance 100, the hot humid air 10 may be drawn into the drying system 300 at the conclusion of a wet cycle of the dishwashing appliance 100 to promote drying of dishes or other articles located in rack assemblies 130 and 132 within the wash chamber 106. As used herein, "hot air" includes air having a temperature of at least about 100° F., such as between about 100° F. and about 160° F., such as between about 115° F. and about 155° F., such as about 135° F. As used herein, terms of approximation, such as "generally," or "about" include values within ten percent greater or less than the stated value. For example, "about 135° F." includes from 121.5° F. to 148.5° F. As used herein, "room temperature" includes temperatures between about 65° F. and about 75° F., such as between about 68° F. and about 72° F., such as about 70° F. As used herein, "dry air" includes air having a relative humidity of about thirty percent or less, such as less than about twenty percent, such as less than about ten percent, such as less than about five percent. As used herein, "humid air" includes air having a relative humidity greater than about eighty percent, such as greater than about ninety percent, such as about one hundred percent.

The hot humid air 10 may be a first flow of hot humid air 10, and may be directed, e.g., via a conduit or duct, from the outlet 301 to the evaporator section 304 of the heat exchanger 302. For example, in some embodiments, the evaporator section 312 of the first heat pipe 310 of the heat exchanger 302 may be in direct fluid communication with the outlet 301 such that the first flow of air 10 flows to and across (e.g., over and around) the evaporator section 312 of the first heat pipe 310. As shown, each of the heat pipes 310, 320, and 330 includes fins at each of the respective evaporator sections 312, 322, and 334, and condenser section 314, 324, and 334. The fins are not labelled in FIG. 4 for clarity, and it should be understood that each set of fins illustrated in FIG. 4 is similar to the fins 212 shown in FIG. 3 and described above. Thus, the first flow of hot humid air 10 may flow across the evaporator section 312 of the first heat pipe 310, including fins thereon, whereupon thermal energy from the first flow of hot humid air 10 is absorbed by working fluid (which is not specifically illustrated in FIG. 4, but is understood to be similar to working fluid 206 shown in FIG. 3 and described above) within the first heat pipe 301, and moisture in the first air flow 10 is released as condensation 11, which is drained, e.g., to sump 142. Thus, a second flow of air 12, which is at a lower temperature than the first flow of hot humid air 10, is provided to the evaporator section 322 of the second heat pipe 320. The second flow of air 12, in at least some embodiments, while cooler than the first flow of air 10, may still be within the range that would be considered "hot air." Also, while the second flow of air 12 will contain less moisture than the first flow of hot humid air 10, due to the reduced temperature of the second flow of air 12 the second flow of air 12 may also be humid air in that the relative humidity of the second flow 12 may be generally the same as the relative humidity of the first flow 10. Subsequently, a third flow of air 14 may be provided from the evaporator section 322 of the second heat pipe 320 to the evaporator section 332 of the third heat pipe 330. Similar to the second flow of air 12 with respect to the first flow of hot humid air 10, the third flow of air 14 may be cooler than the second flow 12 with about the same relative humidity. As shown in FIG. 4, condensation 11 may be formed, e.g., released from the air, at each stage of the evaporator section 304 of the heat exchanger 302, thereby lowering the moisture content at each stage, while the temperature is also lowered, such that the relative humidity remains about the same.

In some embodiments, such as the example embodiment illustrated in FIG. 4, the drying system 300 may be a closed loop system. In such embodiments, the evaporator section 304 of the heat exchanger 302 may be in direct fluid communication with the condenser section 306 of the heat exchanger 302. For example, a first flow of room temperature humid air 16 may be provided directly from the evaporator section 332 of the third heat pipe 330 to the condenser section 334 of the third heat pipe 330.

The first flow of room temperature humid air 16 may flow across, e.g., over and around, the condenser section 334 of the third heat pipe 330, including fins thereon in at least some embodiments. A second flow of room temperature humid air 18 may then flow from the condenser section 334 of the third heat pipe 330 to the condenser section 324 of the second heat pipe 320. At the condenser section 324, the air receives thermal energy from the working fluid of the heat pipe which increases the temperature of the air and consequently reduces the relative humidity of the air, creating a first flow of hot dry air 20. The first flow of hot dry air 20 then flows from the condenser section 324 of the second heat pipe 320 to the condenser section 314 of the first heat pipe 310, where the temperature is again increased and the relative humidity again consequently decreased. Thus, a second flow of hot dry air 22 is then provided from the condenser section 306 of the heat exchanger 302, in particular the condenser section 314 of the first heat pipe 310, to the inlet 308, through which the third flow of hot dry air 22 may enter the wet chamber, e.g., wash chamber 106, to promote drying of articles therein.

As mentioned above, the first heat pipe 310 may have a first operating temperature, the second heat pipe may have a second operating temperature, and the first operating temperature may be greater than the second operating temperature. For example, the first operating temperature may be between about 130° F. and about 150° F., such as about 140° F. and the second operating temperature may be between about 90° F. and about 110° F., such as about 100° F. In some example embodiments, the third heating pipe 330 may have a third operating temperature which is less than the second operating temperature. For example, the third operating temperature may be between about 60° F. and about 80° F., such as about 70° F. With the foregoing example operating temperatures, the first flow of hot humid air 10 may exit the wet chamber at a temperature greater than the first operating temperature, for example, about 160° F. The second flow of air 12 may then be generally equal to the first operating temperature, e.g., about 140° F., and the third flow of air 14 may then be generally equal to the second operating temperature, e.g., about 100° F., and the first and second flows of room temperature air 16 and 18 may then be generally equal to the third operating temperature, e.g., about 70° F. Continuing the example, the first flow of hot dry air 20 from the condenser section 324 of the second heat pipe 320 may have a temperature generally equal to the second operating temperature, e.g., about 100° F., and the second flow of hot dry air 22 may have a temperature generally equal to the first operating temperature, e.g., about 140° F. In such examples, the relative humidity of the first flow of hot dry air 20 may be between about 15% and about 45%, such as about 30% and the relative humidity of the second flow of hot dry air 22 may be between about 0% and about 20%, such as about 10%.

Figure 5:
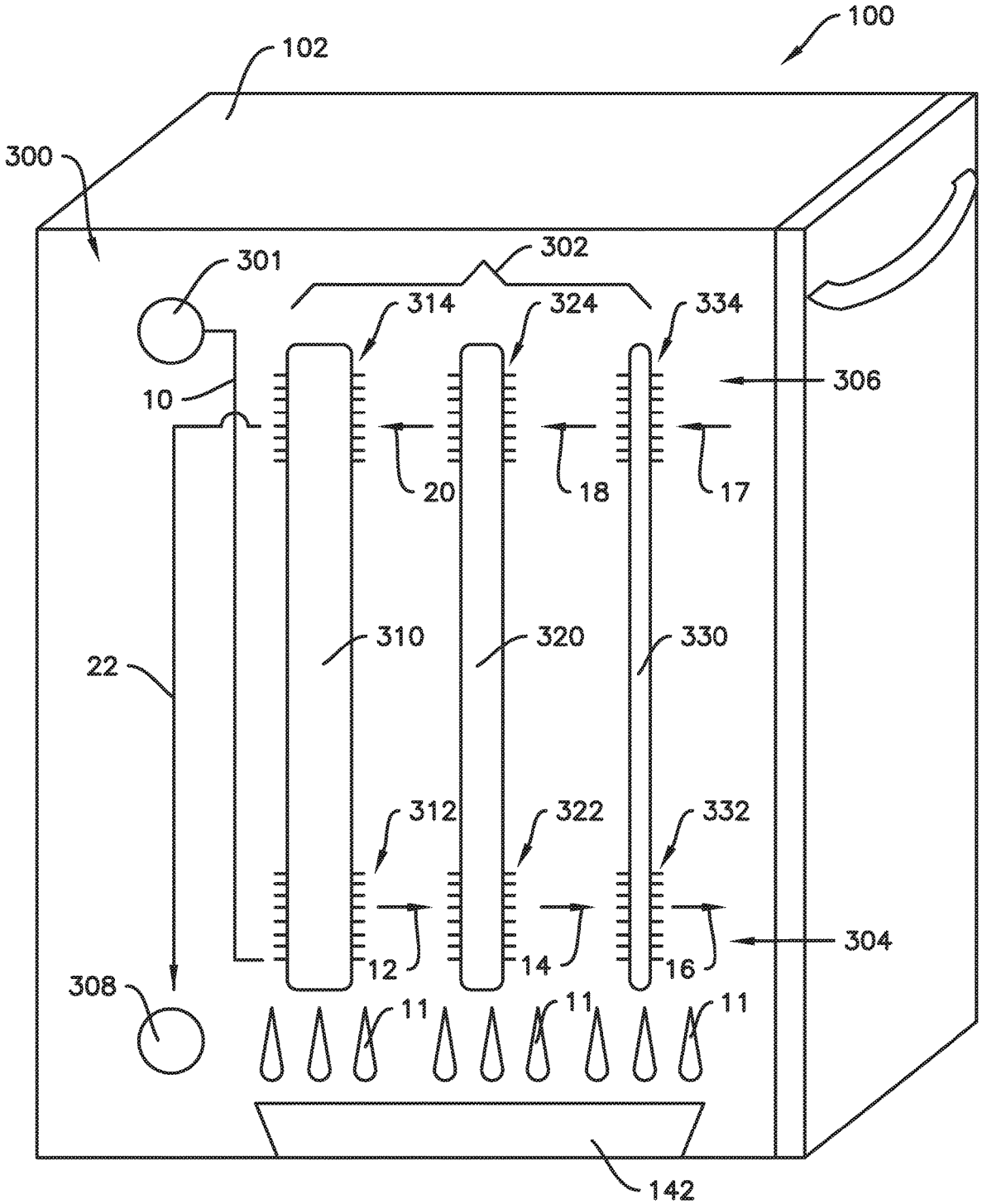
FIG. 5 provides a schematic view of a dishwashing appliance including a drying system according to one or more additional embodiments of the present subject matter.

Turning now to FIG. 5, in some embodiments, the drying system 300 may be an open loop system, e.g., the drying system 300 may be in fluid communication with an ambient environment externally around the drying system 300, e.g., in embodiments where the drying system 300 is provided in dishwasher appliance 100, the ambient environment around, e.g., in close proximity to, an exterior of the dishwashing appliance 100, such as the immediate surroundings of the dishwashing appliance 100 from which air may be drawn directly into an interior of the cabinet 102. In embodiments such as the example illustrated in FIG. 5, the condenser section 306 of the heat exchanger 302 may be in fluid communication with ambient air 17 upstream of the inlet 308. For example, the first flow of room temperature air 16 may be exhausted from the dishwashing appliance 100, and ambient air 17 may be introduced into the drying system 300 at the condenser section 334 of the third heat pipe 330. Then, a second flow of room temperature air 18, e.g., at a temperature generally equal to the operating temperature of the third heat pipe 330, such as about 70° F., may flow from the condenser section 334 of the third heat pipe 330 to the condenser section 324 of the second heat pipe. In open loop systems, such as in FIG. 5, the ambient air 17 may have a relative humidity less than the first flow of room temperature air 16, such as between about 35% and about 70%, such as about 50%. In such embodiments, the second flow of room temperature air 18 will have a relative humidity generally equal to the relative humidity of the incoming ambient air 17. Further, the first flow of hot dry air 20 will have a relative humidity less than the relative humidity of the second flow of room temperature air 18, e.g., between about 10% and about 25%, such as about 15% where the relative humidity of the ambient air 17 and the second flow of room temperature air 18 is about 50%, and the second flow of hot dry air 22 will have a further reduced relative humidity, e.g., between about 0% and about 15%, such as about 5%.

It should be understood that the descriptions above of air flowing from one condenser section of one heat pipe to another condenser section of another heat pipe may also be described more generally as flowing through the condenser section 306 of the heat exchanger 302. Similarly, the descriptions above of air flowing from one evaporator section of one heat pipe to another evaporator section of another heat pipe may also be described more generally as flowing through the evaporator section 304 of the heat exchanger 302.

Figure 6:
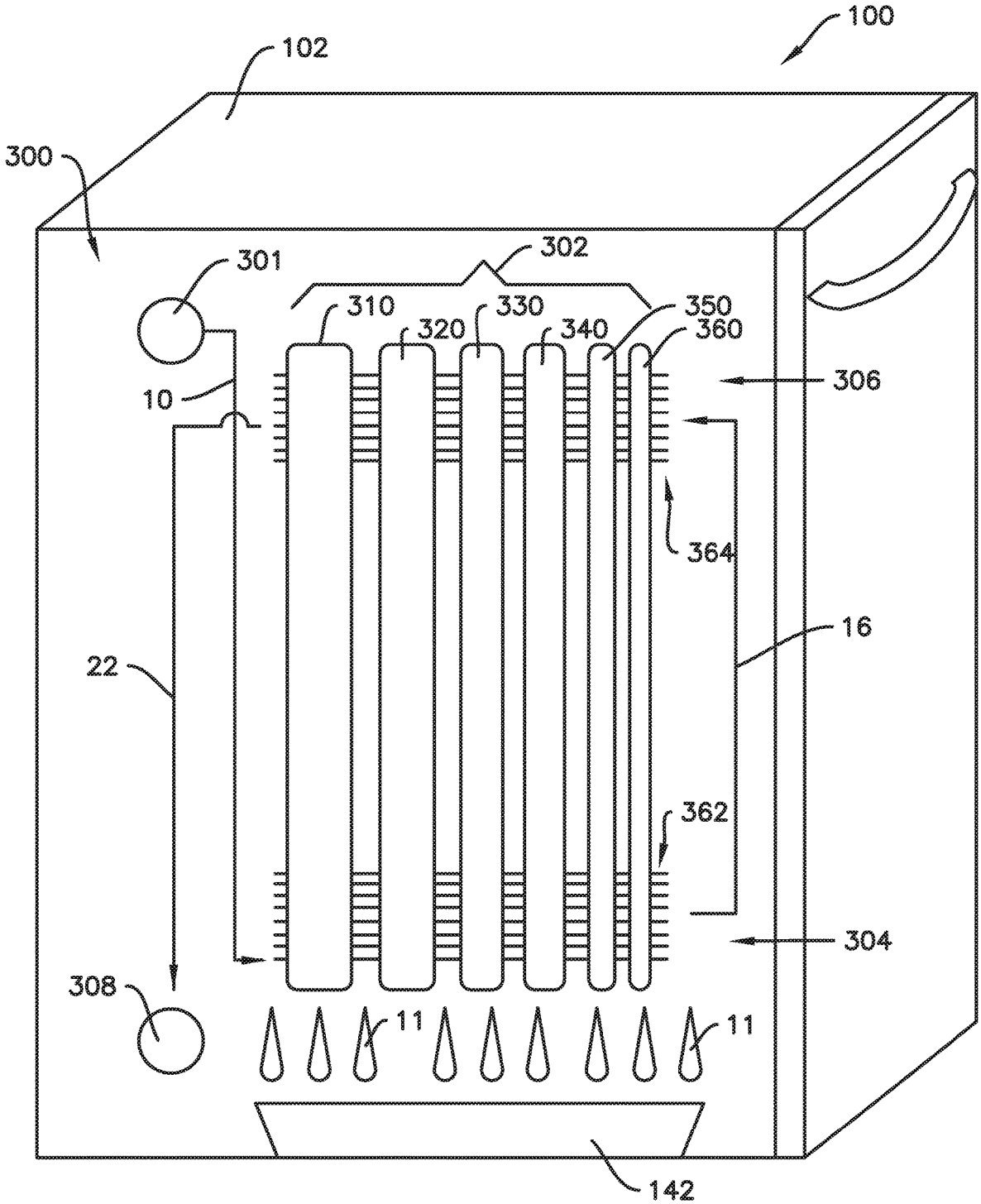
FIG. 6 provides a schematic view of a dishwashing appliance including a drying system according to one or more additional embodiments of the present subject matter.
Figure 7:
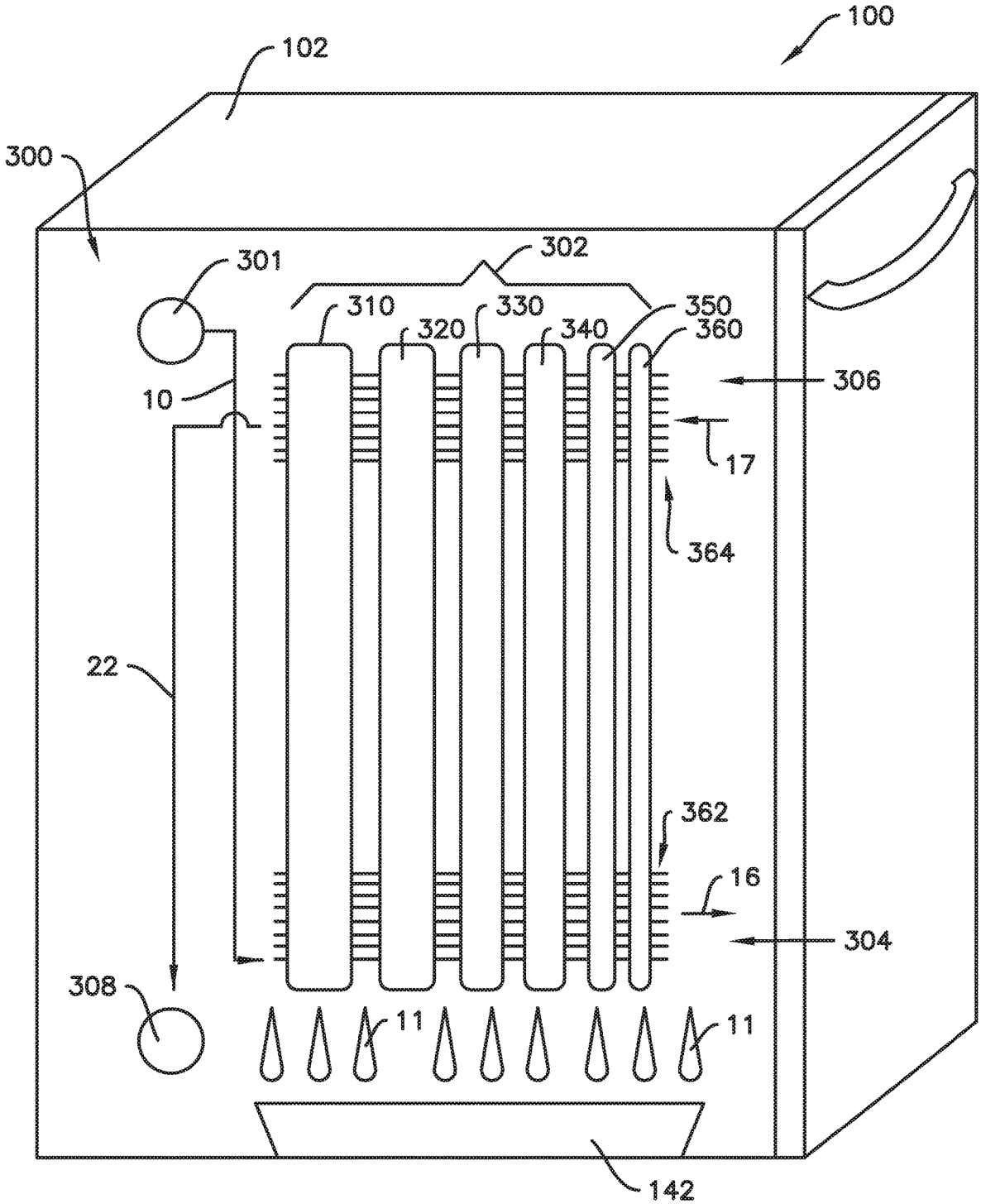
FIG. 7 provides a schematic view of a dishwashing appliance including a drying system according to one or more additional embodiments of the present subject matter.

In some embodiments, for example, as illustrated in FIGS. 6 and 7, the heat pipes of the heat exchanger 302 may be integrally joined. For example, the evaporator sections of the plurality of heat pipes may be integrally joined to each other and the condenser sections of the plurality of heat pipes may be integrally joined to each other, such as at fins of each of the evaporator sections and condenser sections, as shown in FIGS. 6 and 7. In the example embodiments illustrated in FIGS. 6 and 7, the heat exchanger 302 may include a first heat pipe 310, a second heat pipe 320, a third heat pipe 330, a fourth heat pipe 340, a fifth heat pipe 350, and a sixth heat pipe 360, each heat pipe having a distinct operating temperature. For example, each heat pipe may have an operating temperature greater than a subsequent operating temperature, e.g., the first heat pipe 310 may have an operating temperature greater than the operating temperature of the second heat pipe 320, etc. In other embodiments, any suitable number of heat pipes may be used.

FIG. 6 illustrates an example closed-loop drying system 300 with an integrated heat exchanger 302. Similar to the embodiments of FIGS. 4 and 5, the evaporator section 304 of the heat exchanger 302 may be in direct fluid communication with the outlet 301, e.g., at the evaporator section 312 (FIG. 4) of the first heat pipe 310. Similar to the closed-loop system of FIG. 4, in the example embodiment of FIG. 6, the evaporator section 304 of the heat exchanger 302 is in direct fluid communication with the condenser section 306 of the heat exchanger 302. For example, the evaporator section 362 of the sixth heat pipe 360 may be in direct fluid communication with the condenser section 364 of the sixth heat pipe 360.

As shown in FIG. 6, the flow of hot humid air 10 may flow from the outlet 301 and through the evaporator section 304 of the heat exchanger 302, discharging moisture from the air in the form of condensation 11 as it flows through the stages of the evaporator section 304. A flow of room temperature air 16 may then flow from the evaporator section 304 to the condenser section 306. The flow of room temperature air 16 may flow through the condenser section 306 of the heat exchanger 302, gaining thermal energy from the condenser section 306, such that a flow of hot dry air 22 exits the condenser section 306 and flows into the wash chamber 106 via the inlet 308.

FIG. 7 illustrates an example open-loop drying system 300 with an integrated heat exchanger 302. Similar to the embodiments of FIGS. 4 and 5, the evaporator section 304 of the heat exchanger 302 may be in direct fluid communication with the outlet 301, e.g., at the evaporator section 312 (FIG. 4) of the first heat pipe 310. Similar to the open-loop system of FIG. 5, in the example embodiment of FIG. 7, ambient air 17 may be introduced into the drying system 300 at the condenser section 306, such as at the condenser section 364 of the sixth heat pipe 360.

As shown in FIG. 7, the flow of hot humid air 10 may flow from the outlet 301 and through the evaporator section 304 of the heat exchanger 302, discharging moisture from the air in the form of condensation 11 as it flows through the stages of the evaporator section 304. A flow of room temperature air 16 may then be exhausted from the drying system 300 from the evaporator section 304. A flow of ambient air 17 may be provided to the drying system 300, e.g., at and through the condenser section 306 of the heat exchanger 302, gaining thermal energy from the condenser section 306, such that a flow of hot dry air 22 exits the condenser section 306 and flows into the wash chamber 106 via the inlet 308.

The drying system 300 may also include a fan (not shown) configured to urge air through the drying system 300, e.g., from the outlet 301, across and through the evaporator section 304 of the heat exchanger 302, across and through the condenser section 306 of the heat exchanger 302, and back to the wash chamber 106 via the inlet 308, as described above. In various example embodiments, one or more fans may be positioned at or proximate to one or both of the outlet 301 and/or the inlet 308.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

an outlet defined in the tub;

a heat exchanger comprising a plurality of heat pipes, each heat pipe of the plurality of heat pipes having an evaporator section and a condenser section, the evaporator sections of the plurality of heat pipes defining an evaporator section of the heat exchanger and the condenser sections of the plurality of heat pipes of the heat exchanger defining a condenser section of the heat exchanger, the evaporator section of the heat exchanger in fluid communication with the outlet to receive a flow of humid air from the outlet;

an inlet defined in the tub, the inlet configured to receive a flow of dry air from the condenser section of the heat exchanger;

a first air flow path having an origin at the outlet, the evaporator section of the heat exchanger positioned in the first air flow path downstream of the outlet and in direct fluid communication with the outlet, wherein air in the first air flow path flows from the outlet across and through the evaporator section of the heat exchanger, whereby thermal energy from the air in the first air flow path is absorbed by a working fluid of the heat exchanger; and a second air flow path having a terminus at the inlet, the condenser section of the heat exchanger positioned in the second air flow path upstream of the inlet and in direct fluid communication with the inlet, wherein air in the second air flow path flows across and through the condenser section of the of the heat exchanger, whereby thermal energy from the working fluid of the heat exchanger is released to the air in the second air flow path, wherein the plurality of heat pipes comprises a first heat pipe having a first diameter and a second heat pipe having a second diameter less than the first diameter, the evaporator section of the first heat pipe immediately downstream of the outlet, the evaporator section of the second heat pipe downstream of the evaporator section of the first heat pipe, and the condenser section of the first heat pipe downstream of the condenser section of the second heat pipe and immediately upstream of the inlet.

2. The dishwashing appliance of claim 1, wherein the evaporator section of the heat exchanger is in direct fluid communication with the condenser section of the heat exchanger.

3. The dishwashing appliance of claim 1, wherein the evaporator section of the heat exchanger is in fluid communication with ambient air downstream of the outlet.

4. The dishwashing appliance of claim 1, wherein the condenser section of the heat exchanger is in fluid communication with ambient air upstream of the inlet.

5. The dishwashing appliance of claim 1, wherein the plurality of heat pipes of the heat exchanger are spaced apart between the inlet and the outlet.

6. The dishwashing appliance of claim 1, wherein the evaporator sections of the plurality of heat pipes are integrally joined to each other and the condenser sections of the plurality of heat pipes are integrally joined to each other.

7. The dishwashing appliance of claim 1, wherein the dishwashing appliance defines a vertical direction, the condenser section of the heat exchanger positioned above the evaporator section of the heat exchanger along the vertical direction.

8. A drying system comprising:

a tub defining a wet chamber;

an outlet defined in the tub;

a heat exchanger comprising a plurality of heat pipes, each heat pipe of the plurality of heat pipes having an evaporator section and a condenser section, the evaporator sections of the plurality of heat pipes defining an evaporator section of the heat exchanger and the condenser sections of the plurality of heat pipes of the heat exchanger defining a condenser section of the heat exchanger, the evaporator section of the heat exchanger in fluid communication with the outlet to receive a flow of humid air from the outlet; and an inlet defined in the tub, the inlet configured to receive a flow of dry air from the condenser section of the heat exchanger;

a first air flow path having an origin at the outlet, the evaporator section of the heat exchanger positioned in the first air flow path downstream of the outlet and in direct fluid communication with the outlet, wherein air in the first air flow path flows from the outlet across and through the evaporator section of the heat exchanger, whereby thermal energy from the air in the first air flow path is absorbed by a working fluid of the heat exchanger; and a second air flow path having a terminus at the inlet, the condenser section of the heat exchanger positioned in the second air flow path upstream of the inlet and in direct fluid communication with the inlet, wherein air in the second air flow path flows across and through the condenser section of the of the heat exchanger, whereby thermal energy from the working fluid of the heat exchanger is released to the air in the second air flow path, wherein the plurality of heat pipes comprises a first heat pipe having a first diameter and a second heat pipe having a second diameter less than the first diameter, the evaporator section of the first heat pipe immediately downstream of the outlet, the evaporator section of the second heat pipe downstream of the evaporator section of the first heat pipe, and the condenser section of the first heat pipe downstream of the condenser section of the second heat pipe and immediately upstream of the inlet.

9. The drying system of claim 8, wherein the evaporator section of the heat exchanger is in direct fluid communication with the condenser section of the heat exchanger.

10. The drying system of claim 8, wherein the evaporator section of the heat exchanger is in fluid communication with ambient air downstream of the outlet.

11. The drying system of claim 8, wherein the condenser section of the heat exchanger is in fluid communication with ambient air upstream of the inlet.

12. The drying system of claim 8, wherein the plurality of heat pipes of the heat exchanger are spaced apart between the inlet and the outlet.

13. The drying system of claim 8, wherein the evaporator sections of the plurality of heat pipes are integrally joined to each other and the condenser sections of the plurality of heat pipes are integrally joined to each other.

14. The drying system of claim 8, wherein the drying system defines a vertical direction, the condenser section of the heat exchanger positioned above the evaporator section of the heat exchanger along the vertical direction.

* * * * *